United States Patent [19]

Acquaviva

[11] 4,214,740

[45] Jul. 29, 1980

[54] SHEET REVERSING MECHANISM

[75] Inventor: Thomas Acquaviva, Penfield, N.Y.

[73] Assignee: Xerox Corporation, Stamford, Conn.

[21] Appl. No.: 902,136

[22] Filed: May 2, 1978

[51] Int. Cl.[3] ..... B65H 5/06; B65H 29/20

[52] U.S. Cl. ..... 271/3; 271/184; 271/188; 271/272; 271/DIG. 9

[58] Field of Search ..... 271/DIG. 9, 188, 65, 271/3, 184, 186, 225, 80, 272, 273, 274, 314

[56] References Cited

U.S. PATENT DOCUMENTS

| | | | |
|---|---|---|---|
| 3,095,192 | 6/1963 | Simjian | 271/3 |
| 3,416,791 | 12/1968 | Beckman et al. | 271/65 |
| 3,523,687 | 8/1970 | Petersen et al. | 271/DIG. 9 X |
| 3,768,803 | 10/1973 | Stange | 271/34 |
| 3,856,295 | 12/1974 | Looney | 271/65 |
| 3,874,290 | 4/1975 | Suzuki | 271/DIG. 9 X |
| 3,920,238 | 11/1975 | Kitajima et al. | 271/9 |
| 3,942,785 | 3/1976 | Stange | 271/65 |
| 3,944,212 | 3/1976 | Stange et al. | 271/65 X |
| 4,033,574 | 7/1977 | Stange et al. | 271/3 |
| 4,049,255 | 9/1977 | Stange et al. | 271/DIG. 9 X |
| 4,054,285 | 10/1977 | Stange et al. | 271/186 |

FOREIGN PATENT DOCUMENTS

| | | | |
|---|---|---|---|
| 1206965 | 9/1970 | United Kingdom | 271/188 |
| 1439268 | 6/1976 | United Kingdom | 271/188 |

*Primary Examiner*—Bruce H. Stoner, Jr.
*Attorney, Agent, or Firm*—Ronald F. Chapuran

[57] ABSTRACT

A sheet reversing mechanism having drive rolls independently activated for driving sheets into and out of a sheet reversing station at different rates. A first shaft supports a drive roll engaging an idler roll supported on a second shaft and a drive roll supported on the second shaft engages an idler roll supported on a third shaft. The diameters of the idler roll and the drive roll on the second shaft are different providing corrugations in sheets driven out of the reversing station.

8 Claims, 2 Drawing Figures

SHEET REVERSING MECHANISM

BACKGROUND OF THE INVENTION

This invention relates to sheet handling systems and more particularly, to sheet reversing mechanisms. Prior art sheet reversing mechanisms such as in duplex copying and collating in electrostatographic printing machines often use a roller system for driving sheets to and from a reversing station. U.S. Pat. No. 4,054,285, assigned to the same assignee as the present invention, shows a roller system having a center drive roll engaging two sets of idler rolls. The center drive roll engages the first set of idler rolls to convey sheets into a bin and engages the second set of idler rolls to convey sheets away from the bin. The center drive roll simultaneously drives both sets of idler rolls at the same rate. A limitation with this mechanism is the inability to drive a sheet into and out of the bin at different rates. Therefore, it would be desirable to provide a sheet reversing mechanism in which sheets can be driven into a bin or reversing station at one rate and driven out of the reversing station at a different rate.

In sheet handling systems, it is often necessary to deskew or preregister a sheet before conveying to the next station. In prior art systems having two sets of idler rolls driven by the same drive rolls, it is not possible to stop movement of one set of idler rolls without stopping movement of the other set of idler rolls. Therefore, either an incoming or outgoing sheet cannot be stopped by the rolls for deskewing, preregistration or timing without stopping both the incoming and outgoing sheets. It would, therefore, be desirable to provide a sheet conveying system in which the rolls driving the incoming sheets are operable independent of the rolls driving the outgoing sheets.

There is often the problem of sheet jams in sheet handling systems as a result of a sheet conveyed between a pair of pinch rolls being carried around one of the rolls or a sheet will have insufficient beam strength to be suitably conveyed. This problem can be minimized by providing corrugations in the sheet as shown in British Pat. No. 1,439,268. However, the apparatus as described in British Pat. No. 1,439,268 is not applicable to sheet reversing systems. It would, therefore, be desirable to provide a sheet reversing mechanism having apparatus delivering corrugated sheets to an output station.

Accordingly, it is a primary object of this invention to provide an improved sheet reversing mechanism having independent control of the input and output sheets and providing easy to handle sheets at the output station.

SUMMARY OF THE INVENTION

Briefly, the present invention is concerned with a sheet reversing and feeding mechanism having drive rolls independently activated. A first shaft supports a drive roll engaging an idler roll supported on a second shaft for driving sheets out of the reversing station and a drive roll supported on the second shaft engages an idler roll supported on a third shaft for driving sheets into the reversing station. The diameters of the idler roll and the drive roll on the second shaft are different providing corrugations in sheets driven out of the reversing station.

BRIEF DESCRIPTION OF THE DRAWINGS

Other objects and advantages of the present invention will become apparent upon reading the following detailed description and upon reference to the drawings wherein same reference numerals have been applied to like parts and wherein.

DETAILED DESCRIPTION OF THE INVENTION

Figure 1:
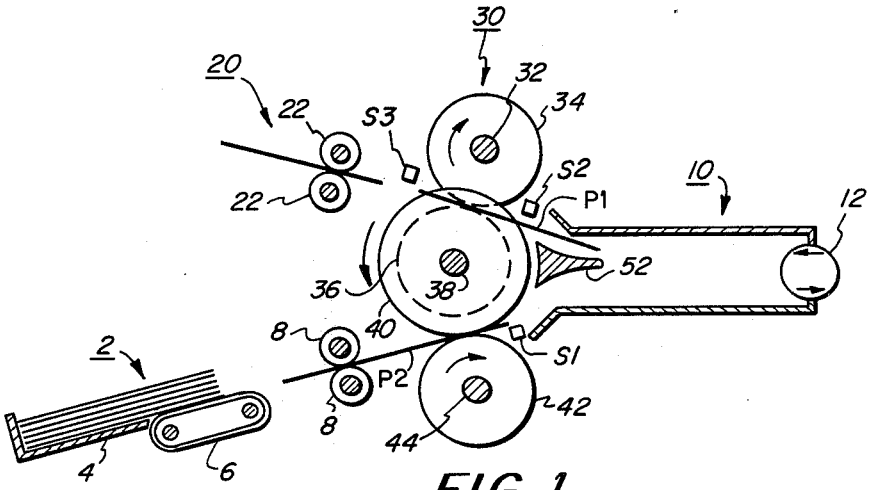
FIG. 1 is a schematic side view of a sheet conveying system.

Referring now to the drawings, there is illustrated in FIG. 1 a sheet conveying system comprising an input station 2 having an input tray 4 with associated sheet transport 6 and pinch rollers 8, a reversing station 10 having drive means 12 to facilitate entry and exit of sheets with respect to the reversing station 10, an output station 20 with associated pinch rollers 22, and a multi-roll mechanism 30 interconnecting the input and output stations 2, 20 with the reversing station 10. It should be understood that the reversing station can be any station for reversing sheets in machines such as electrostatographic printing machines. For example, the reversing station could be a platen in an electrophotographic machine or any station where reversing may be necessary such as in duplex copying. The drive means 12 to facilitate entry and exit of sheets could be a pneumatic system, a friction device or any other suitable driving method. It should also be noted that the input station is not necessarily limited to an input tray but could be any station in the sheet conveying system for providing sheets.

Figure 2:
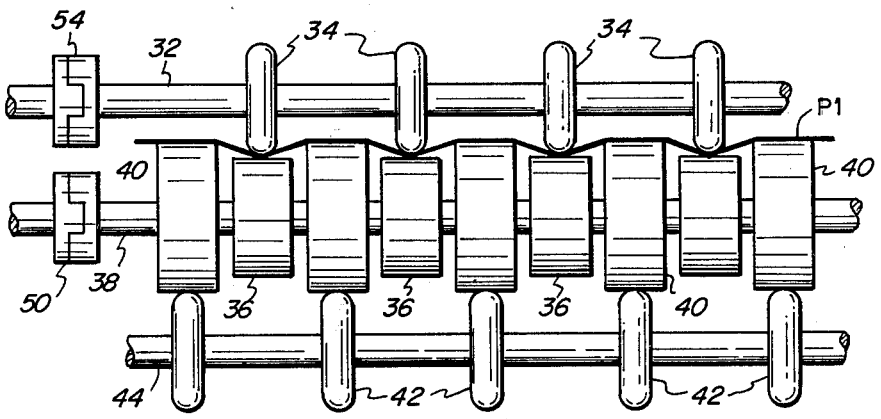
FIG. 2 is an enlarged view of the sheet reversing mechanism in accord with the present invention.

In accord with the present invention as best illustrated in FIGS. 1 and 2, the multi-roll mechanism 30 comprises a three shaft arrangement with associated driving and idler rolls. A first shaft 32 supports a set of drive rolls 34 engaging a set of idler rolls 36 on a second shaft 38. In addition to supporting idler rolls 36, the second shaft 38 supports a set of drive rolls 40 engaging a set of idler rolls 42. The idler rolls 42 are carried by a third shaft 44. As illustrated, the set of drive rolls 34 and the sets of idler rolls 36, 42 have approximately the same diameter substantially less than the diameter of the set of drive rolls 40. Thus, outgoing sheets, such as sheet P1, are not only pinched between rolls 34 and 36 but also overlie rolls 40. This provides corrugations in the outgoing sheets as best illustrated in FIG. 2.

As illustrated by the arrows in FIG. 1, the first shaft 32 rotates in a clockwise direction driving the set of drive rolls 34 in a clockwise direction. The drive rolls 34 in turn drive the set of idler rolls 36 in a counter-clockwise direction. The second shaft 38 and the set of drive rolls 40 rotate in a counter-clockwise direction driving the set of idler rolls 42 in a clockwise direction. To facilitate the control of sheets entering and leaving the multi-roll mechanism 30 there are provided sensors S1, S2 and S3 along the paper path.

In operation, as best seen in FIG. 1, a sheet P1 is exiting the reversing station 10 and a sheet P2 is positioned to enter reversing station 10. Sensor S1 controls the positioning of incoming sheets for movement into reversing station 10. Sensor S2 controls the initiation of movement of sheets out of reversing station 10 under control of drive rolls 34 independent of the control of incoming sheets by drive rolls 40. Sensor S3 controls the initiation of movement of sheets into the reversing station 10 to avoid interference with outgoing sheets conveyed toward output station 20. In particular, the sensor S1 responds to the presence of the sheet P2 at a predetermined location along the input paper path to initiate the stopping of the shaft 38 and the drive rolls 40 through a solenoid activated clutch 50 or other suitable mechanical linkage. The de-activation of clutch 50 stops the sheet P2 at the nip of the rolls 40 and 42. Preferably, sheet P2 is engaged by rolls 40 and 42 until the leading edge of sheet P1 has been conveyed from reversing station 10 to a position safe from interference with an incoming sheet. A deflector 52 is provided to direct outgoing sheets such as P1 upwardly toward engagement with rolls 34 and 36. Sensor S2 detects the leading edge of a sheet P1 moving out of the reversing station 10 to initiate engagement of drive shaft 32 through solenoid activated clutch 54 or other suitable mechanical linkage. Drive rolls 34 supported by shaft 32 engage idler rolls 36 supported on shaft 38 to convey sheet P1 toward output station 20. Sensor S3 detects the leading edge of the sheet P1 to initiate the movement of drive rolls 40 and convey sheet P2 into the reversing station 10.

The incoming sheets P2 are in a preregistered or hold position to be conveyed immediately into reversing station 10 after outgoing sheets P1 have reached a predetermined location. It is only necessary to convey incoming sheets from the position at the nip of rolls 40 and 42 into the reversing station 10 rather than from input tray 4. The savings in distance traveled is also savings in time to convey sheets into reversing station 10, providing a higher thruput operation. If deskewing of sheets P1 is required before entering output station 20, sensor S3 can also detect the leading edge of sheet P1 to disengage the drive rolls 34. This will provide for deskewing of the sheet P1 in the nip of the rolls 34 and 36 before the rolls 34 and 36 are activated. A sufficient time delay from the sensing of the leading edge of sheet P1 by sensor S2 until the activation of drive rolls 34 will then be required to allow for deskewing of sheet P1 in the nip of rolls 34 and 36.

It should be understood that both sets of idler rolls could be supported by the second shaft 38 with the rolls 34 and 42 being the drive rolls and there may be other variations of driving and idler roll diameters. While the exemplary embodiment described herein is at present considered to be preferred, it will be appreciated that numerous changes and modifications are likely to occur to those skilled in the art and it is intended in the appended claims to cover all those changes and modifications which fall within the true spirit and scope of the present invention.

What is claimed is:

1. Sheet reversing apparatus having
a sheet input station
a sheet output station,
a reversing station receiving a sheet from the input station for conveyance to the output station and a roller mechanism coupled to the reversing station, the roller mechanism comprising
a first roller system,
a second roller system, the first roller system engaging the second roller system, and
a third roller system, the third roller system engaging the second roller system, the second roller system having concentrically supported first and second rolls rotatable relative to one another, the diameter of the first roll being different from the diameter of the second roll, the first roller system continuously engaging the first roll for conveying sheets from the input station to the reversing station and the third roller system continuously engaging the second roll to convey sheets from the reversing station to the output station, wherein the first and second rolls are adapted for independent operation.

2. The apparatus of claim 1 wherein the first roller system is driven by the first roll and wherein the second roll is driven by the third roller system.

3. The apparatus of claim 2 wherein the first and second rolls provide corrugations in the sheet conveyed from the reversing station to the output station.

4. The apparatus of claim 1 wherein the first and second rolls are idler rolls.

5. The apparatus of claim 1 wherein the roller systems include means to convey a sheet from the input station to the reversing station at a rate independent of the rate of conveyance of a sheet from the reversing station to the output station.

6. The apparatus of claim 1 wherein the reversing station is a platen, one of the first roller system and the first roll being clutch controlled for conveying a sheet from the input station to the platen, and one of the third roller system and the second roll being clutch controlled for conveying a sheet from the platen to the output station.

7. In a sheet reversing system, the combination of a
sheet input station,
a sheet output station,
a reversing station receiving sheets from the input station for conveyance to the output station, and
a roller mechanism coupled to the reversing station, the roller mechanism having
a first shaft,
a first roll supported by the first shaft,
a second shaft,
a second and a third roll concentrically supported by the second shaft, the diameter of the second roll being different than the diameter of the third roll,
said second and third rolls being rotatable relative to one another,
a third shaft, and
a fourth roll supported by the third shaft, the first roll continuously engaging the second roll for conveying sheets from the input station to the reversing station and the third roll continuously engaging the fourth roll for conveying sheets from the reversing station to the output station whereby the first and second rolls are driven independently of the third and fourth rolls.

8. The system of claim 7 wherein one of the first and fourth rolls is a driving roll and one of the second and third rolls is an idler roll.

* * * * *